United States Patent [19]

Shiloni

[11] 4,080,889

[45] Mar. 28, 1978

[54] DEVICE FOR COMPACTING TRASH AND THE LIKE

[76] Inventor: Mordechay Shiloni, 7702 Hanover Pkwy., Apt. 302, Greenbelt, Md. 20770

[21] Appl. No.: 696,852

[22] Filed: Jun. 16, 1976

[51] Int. Cl.[2] ..... B30B 1/34; B30B 15/16

[52] U.S. Cl. ..... 100/52; 100/3; 100/53; 100/219; 100/226; 100/255; 100/258 A; 100/269 R; 100/295

[58] Field of Search ..... 100/43, 226, 255, 295, 100/50, 52, 46, 258 R, 258 A, 3, 269 R, 240, 245, 53

[56] References Cited

U.S. PATENT DOCUMENTS

| | | | |
|---|---|---|---|
| 3,438,321 | 4/1969 | Gladwin | 100/226 X |
| 3,548,744 | 12/1970 | Van Doorn | 100/255 |
| 3,757,680 | 9/1973 | Williams | 100/269 R |
| 3,910,181 | 10/1975 | Andrews | 100/226 |

*Primary Examiner*—Billy J. Wilhite

*Attorney, Agent, or Firm*—Lowe, King, Price & Markva

[57] ABSTRACT

A device for compacting trash and the like comprises a bin having an open top through which the material to be compacted can be passed and walls which define a volume into which the material is deposited. A horizontally disposed, rectangular pressure plate for compacting the material is horizontally driven from a zone horizontally removed from the open top into a region above the volume. The pressure plate is vertically driven between the region and the volume to compact the material in the bin and is returned to the region. The plate is vertically driven by first and second vertical pistons that are respectively positioned to drivingly engage opposite, straight, parallel edges of the pressure plate. The pistons are separately driven by fluid pressure until the fluid pressure acting on one of the pistons reaches a predetermined value. The pressure plate is horizontally driven from a first pair of stationary channels, at the zone, into a second pair of channels, at the region; the second pair of channels is verticaly driven by the pistons. The entire sequence is normally automatic and is initiated in response to an operator activating a pushbutton. When it is desired to remove the compacted material from the bin, the automatic sequence is altered so that the pressure plate is stopped when the predetermined pressure is reached. With the pressure plate in the compacting position, a door is opened and baling wire is inserted into aligned longitudinal grooves in a floor of the bin, in the pressure plate, and in a wall of the bin opposite from the door. To facilitate removal of a wrapped bale, a door is provided on each of a pair of adjacent bin walls that are substantially at right angles to each other. The doors have abutting, latched edges, when closed.

16 Claims, 7 Drawing Figures

DEVICE FOR COMPACTING TRASH AND THE LIKE

FIELD OF INVENTION

The present invention relates generally to devices for compacting trash and the like, and more particularly to a compactor wherein a pressure plate is vertically driven in a bin.

BACKGROUND OF THE INVENTION

There is presently a need for an improved device for compacting trash and the like which is particularly adapted for use in retail establishments, such as supermarkets, small department stores and shopping centers, as well as office buildings, apartments and other establishments of a like nature. Presently, the most common method of collecting trash and like products from such establishments is to pick up the trash and carry it to a remote site, after compacting on a vehicle. Compacting on the vehicle is relatively inefficient because the material has an opportunity to expand considerably after each loading and compacting operation. Also, there is usually no provision for baling the material on the vehicle, so that unloading is difficult and inefficient.

While certain machines have been developed to compact and bale at sites of the type referred to above, these machines have not generally been widely accepted. The prior art devices have design defects which have resulted in hang-up of a compacting pressure plate or platen. Also, many of the proposed prior art devices have been relatively complex, and therefore expensive.

BRIEF DESCRIPTION OF THE INVENTION

In accordance with the present invention, a relatively inexpensive and simple device for compacting trash and the like and for enabling it to be baled at sites, such as supermarkets, shopping centers, small department stores, office buildings, apartment houses, etc., includes a bin having an open top through which the material can be deposited easily, since the top is at a relatively low height, where an operator can easily deposit the material into the bin. A horizontally disposed pressure plate for compacting the material is horizontally driven from a zone horizontally removed from the open top of the bin into a region above the volume where the material is deposited, i.e., above the open top of the bin. The plate thereby effectively forms a ceiling for the bin when it is in position above the volume, at the region. The pressure plate is driven downwardly from the region into the bin to compact the material and is thereafter upwardly driven, back to the region.

The pressure plate is horizontally and vertically driven by providing first and second horizontally disposed shelf means for holding the pressure plate. The pressure plate is initially horizontally driven from the first shelf means, which is stationary, into the second shelf means, that is vertically driven by a pair of hydraulically activated pistons. While the bin is being loaded with material, the pressure plate is held on the first shelf means at the zone horizontally removed from the bin. When it is desired to compact the material in the bin, an operator activates a switch which causes the pressure plate to be horizontally driven into a pair of channels that define the second shelf means. The channels include horizontally extending upper and lower flanges, the latter of which are initially horizontally aligned with the first shelf means. In response to the pressure plate being driven into the region, at a position above the volume defined by the bin walls, the channels are vertically driven by the pistons which provide independent parallel drives for parallel, opposite edges of the rectangular pressure plate. To facilitate translation of the pressure plate into the channels, the ends of the channels that receive the pressure plate from the first shelf are outwardly flared.

In the normal sequence, the pressure plate is vertically driven until the fluid pressure exerted on one of the pistons reaches a predetermined value, indicative of the desired maximum pressure to be applied by the pressure plate to the material or load being compacted. In response to the predetermined pressure being reached on one piston, the drives for both pistons are deactivated so that the pressure plate remains in situ and has a tendency to remain relatively horizontal, even though there are independent drives to opposite edges of the pressure plate. The parallel drive against the opposite edges of the pressure plate enables the device of the present invention to employ relatively small pistons, yet provide adequate compacting pressure for the types of loads to be encountered. In one particular embodiment of the device, wooden baskets and cardboard boxes were compressed by a rectangular pressure plate having dimensions of approximately 32 inches by 32 inches, driven by a pair of pistons having a 1.75 inch diameter, to a maximum pressure of 1200 psi.

Normally, in response to the maximum pressure being reached, the pressure plate is driven upwardly by the pair of vertical pistons, until the region above the bin volume is reached. In response to the pressure plate reaching the region, it is retracted to the zone removed from the top of the bin, where it remains until a new cycle is initiated by the operator activating an automatic start button. In one particular embodiment the entire automatic sequence requires between 22 to 30 seconds.

When a bale of desired height has been formed by a succession of operations, the operator changes the normal sequence of operation, whereby the pressure plate remains in the bin in response to the maximum pressure being reached on one of the pistons. The pressure plate remains in situ while the operator opens a door for the bin and inserts baling wires in aligned longitudinal grooves provided in the floor, pressure plate and a wall of the bin opposite from the door. To facilitate removal of the wrapped bale from the compactor, adjacent, orthogonally disposed walls of the bin are formed as doors having abutting, latched edges when closed. When it is desired to remove the bale, pressure on the bale is released since both doors readily swing open; whereby the bale is easily removed.

It is, accordingly, an object of the present invention to provide a new and improved device for compacting trash and the like.

Another object of the invention is to provide a new and improved trash compacting device that is particularly suited for use in supermarkets, shopping centers, small department stores, apartments, office buildings, and other like places.

Another object of the present invention is to provide a new and improved trash compacting device wherein the material to be compacted is easily loaded into a bin, through an open top.

An additional object of the invention is to provide a new and improved trash compacting device that is completely automatic and wherein the automatic cycle can be altered at will.

Another object of the invention is to provide a new and improved trash compacting device including a bin having doors arranged so that removal of the compacted material is facilitated.

A further object of the invention is to provide a new and improved trash compacting device which enables cardboard boxes and wooden baskets to be compacted, even though the device is relatively small, simple and inexpensive.

The above and still further objects, features and advantages of the present invention will become apparent upon consideration of the following detailed description of several specific embodiments thereof, especially when taken in conjunction with the accompanying drawing.

DETAILED DESCRIPTION OF THE DRAWING

Figure 1:
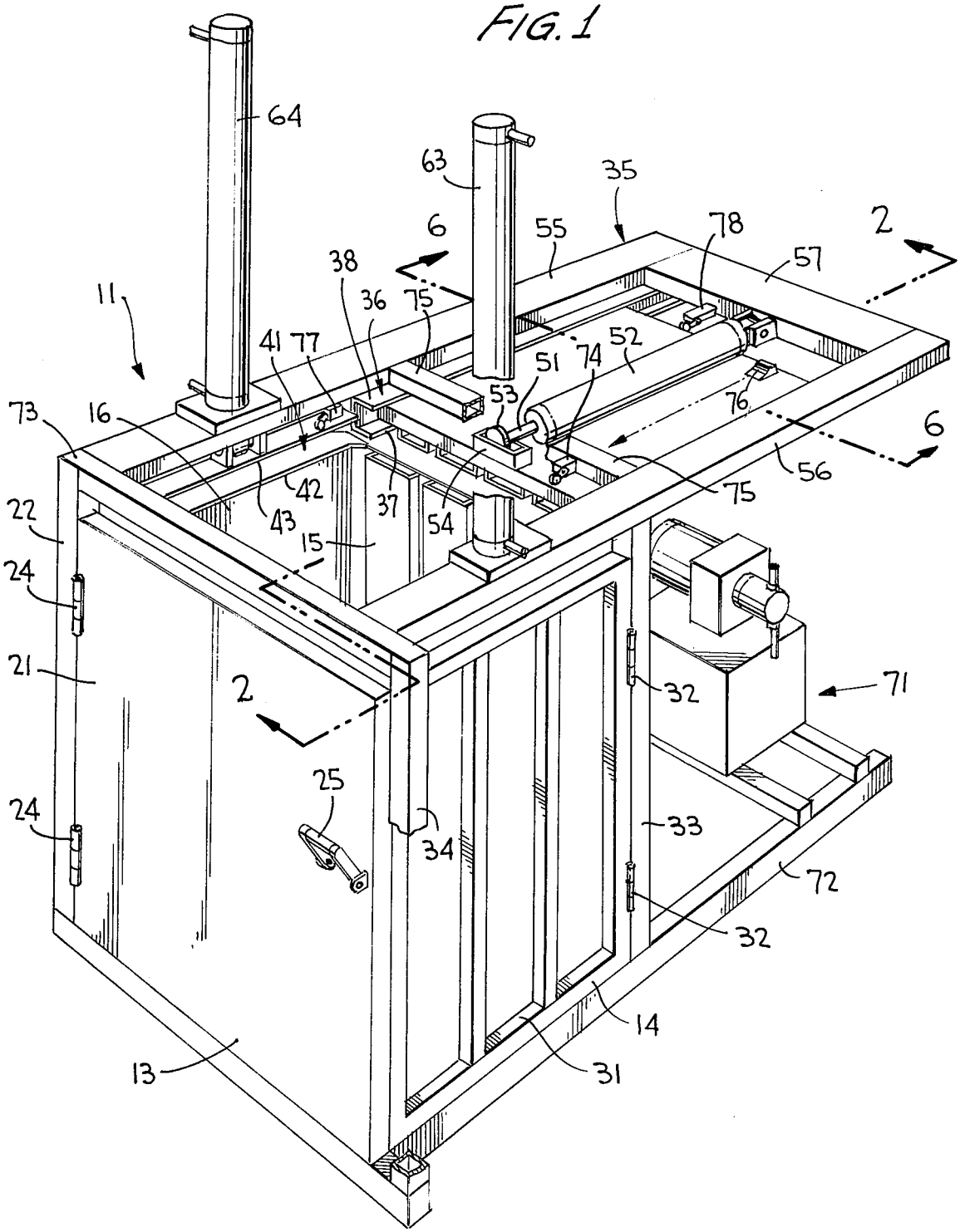
FIG. 1 is a perspective view of an overall view of a preferred embodiment of the invention.
Figure 2:
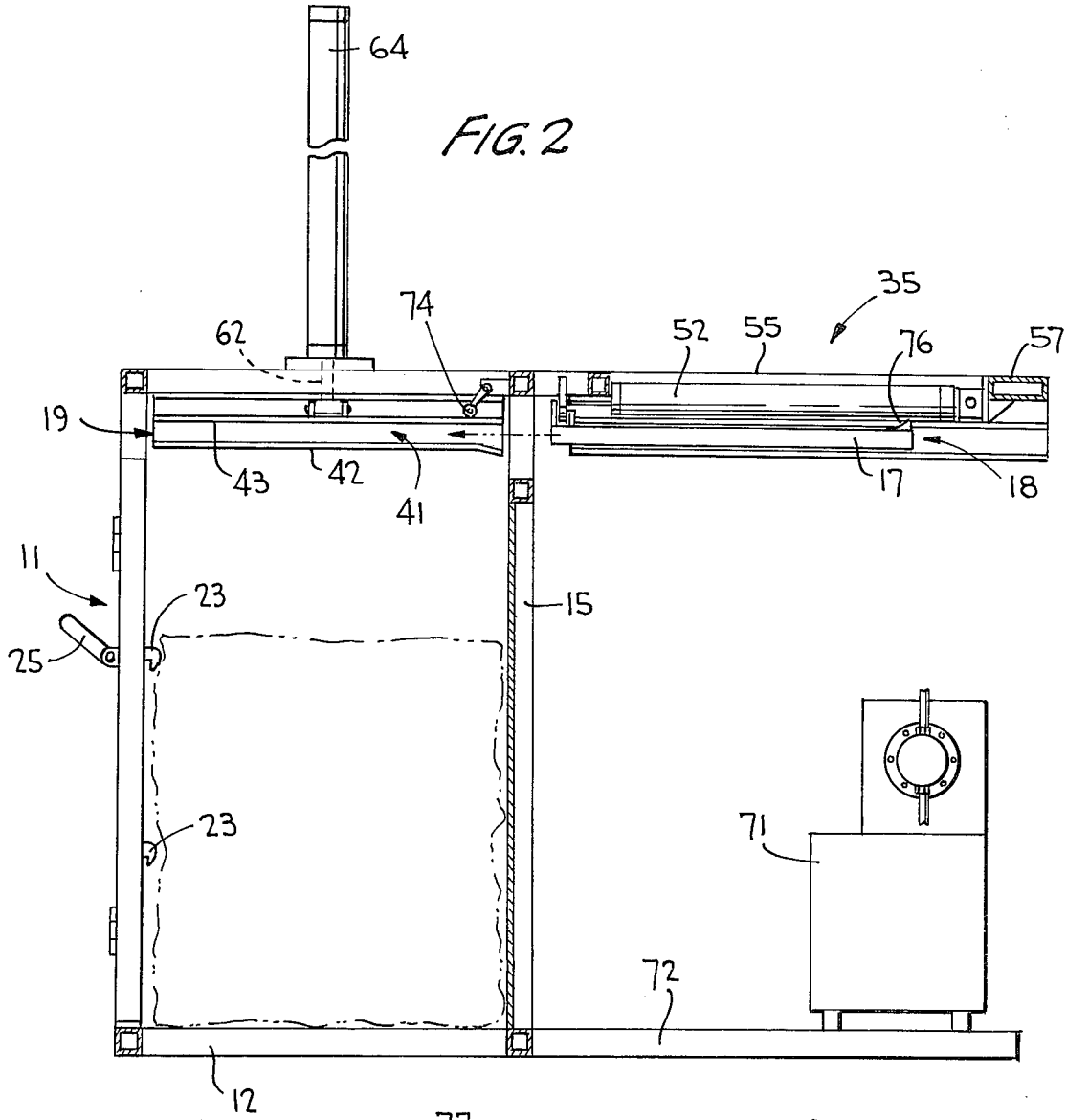
FIG. 2 is a side view, partly in section, taken through the lines 2—2 of FIG. 1.
Figure 3:
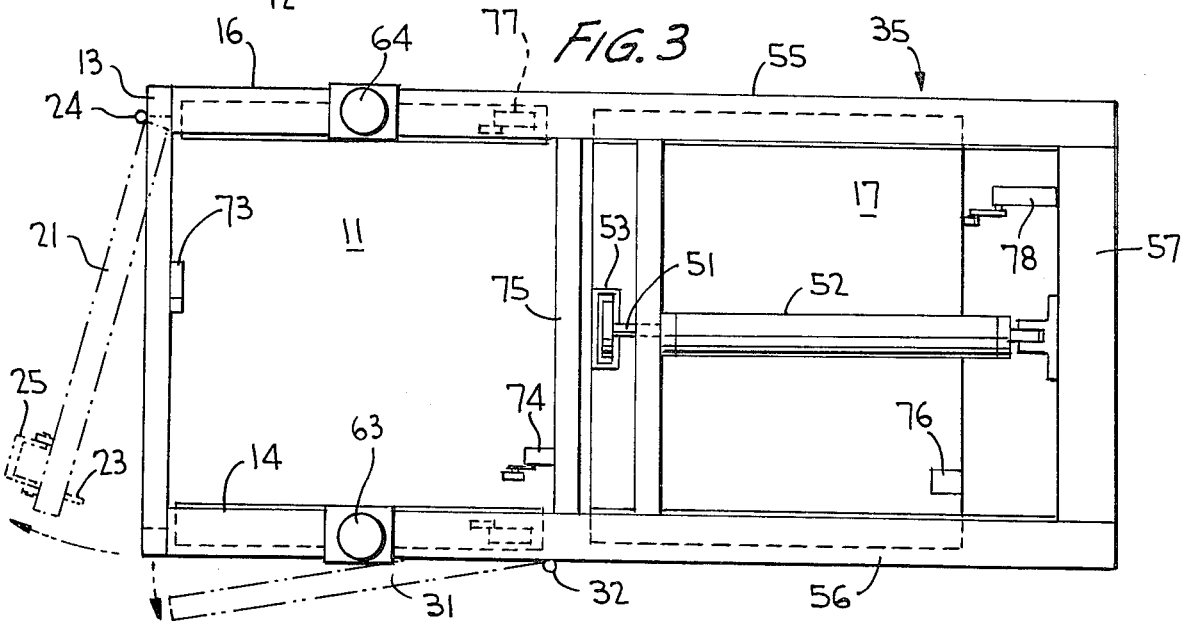
FIG. 3 is a top view of the device illustrated in FIG. 1.

Reference is now made to FIGS. 1-6 of the drawing wherein there is illustrated a preferred embodiment of a device for compacting trash and the like, in accordance with the present invention. The compacting device includes a relatively short bin 11 having an open top, a floor 12, and four mutually orthogonal walls 13-16 which define a volume into which the material to be compacted is deposited in bin 11. Bin 11 has an overall height of approximately 5 feet so that various types of trash, including cardboard boxes and wooden baskets, can easily be inserted into it through the open top by an operator.

Compacting of the trash in bin 11 is performed by horizontally disposed, rectangular pressure plate or platen 17. Normally, platen 17 is horizontally disposed in zone 18 that is horizontally removed from region 19 above the compacting volume defined by bin 11. After a mass of material has been passed through region 19 and deposited into bin 11 and it is desired to compact this mass of material, pressure plate 17 is horizontally translated into region 19, thence it is vertically translated in bin 11 to engage and compact the mass of material in the bin. After a compacting stroke has been completed, pressure plate 17 is vertically raised in bin 11 and returns to region 19, thence it is horizontally returned to zone 18. Thereby, additional trash can be loaded into bin 11 through the open top.

After several compacting sequences, when bin 11 becomes relatively full of compacted material, a bale is formed by wrapping wire around the compacted mass of material in the bin. To these ends, wall 13 of bin 11 is formed primarily as a door 21 that is hinged to standard 22 and latched by hooks 23 to wall 14. Hooks 23 are vertically translated relative to latching slots provided in the front edge of wall 14 against which the inside face of door 21 abuts while the door is closed. To open door 21, the operator pushes handle 25 down, to unlatch the door, and then pulls the door out so that it pivots about its hinges 24 that are secured to standard 22. When it is desired to form a bale of the compacted mass of material in bin 11, door 21 is opened by the operator, who then inserts baling wire completely around the compacted mass of material. To facilitate insertion of the baling wire, floor 12, back wall 15, and the bottom of pressure plate 17 are respectively provided with aligned longitudinal slots 26-28. Baling wire 29 is inserted into the aligned slots to encircle the compacted mass of trash; the ends of the wire are then secured together.

Removal of the compacted bale of trash is facilitated by forming a major part of wall 14 of bin 11 as door 31 that has an abutting edge with door 21. The abutting edges of doors 21 and 31 are latched together by providing door 31 with the slots into which hooks 23 fit when the doors are both closed. Door 31 is pivoted to open outwardly by the connection of its hinges 32 to standard 33. A further standard 34 is located adjacent the latched, abutting edges of doors 21 and 31, but is spaced sufficiently from the latched edges to enable the compacted bale to be easily removed from bin 11. To provide stability for walls 13-16 of bin 11, a further standard (not shown) is provided at the intersection of walls 15 and 16.

Zone 18, where pressure plate 17 is normally located, is included in a cantilevered structure 35 that extends from the back wall 15 of bin 11 including longitudinally extending horizontal beams 55 and 56 that are fixedly supported by the standards of bin 11. Between the back ends of beams 55 and 56, a cross beam 57 is fixedly mounted. Fixedly attached to cantilevered structure 35 is a pair of longitudinally extending channels 36 (best shown in FIG. 6) that lie in the same horizontal plane to effectively establish a shelf, against which opposite edges of rectangular pressure plate 17 rest. Each of channels 36 includes lower and upper horizontally extending flanges 37 and 38, between which the lower and upper faces of plate 17 are normally positioned.

The mechanism for vertically traversing pressure plate 17 in bin 11 includes a pair of channels 40 and 41 (best illustrated in FIG. 5) that effectively forms a second shelf on which pressure plate 17 rests while it is being vertically traversed. In the rest position of pressure plate 17, illustrated in FIGS. 1-3, the shelves defined by channels 36, 40 and 41 are horizontally aligned so that the pressure plate can be transferred between the two shelves. Each of channels 40 and 41 includes lower and upper horizontally extending flanges 42 and 43, having approximately the same spacing from each other as the spacing between flanges 37 and 38; the lower and upper flanges of channels 36 and 41 are aligned with each other while pressure plate 17 is in the rest position and is being transferred between zone 18 and region 19. To facilitate transfer of pressure plate 17 from zone 18 to region 19, the botton flanges 42 of channels 40 and 41, located just above the bin back wall 15, are downwardly flared.

Figure 4:
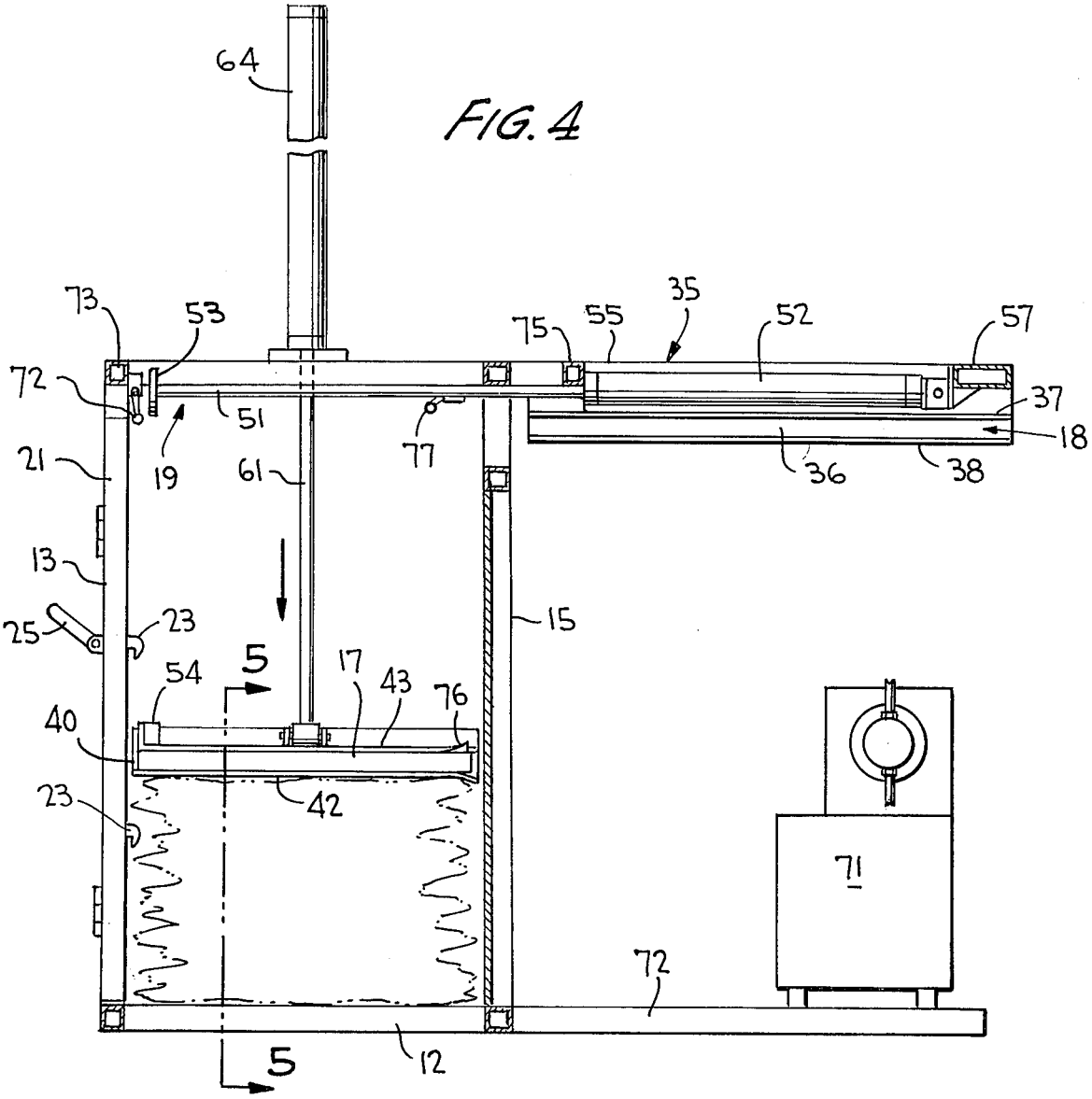
FIG. 4 is a side elevational view of the device, wherein a pressure plate is in a lowered position.
Figure 5:
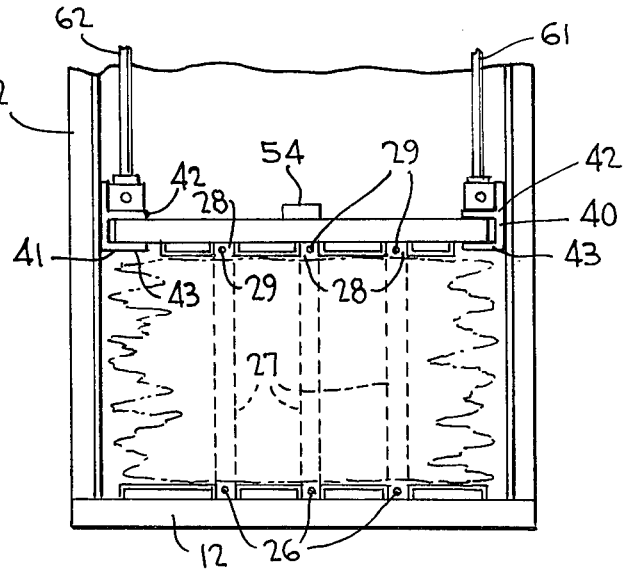
FIG. 5 is a front sectional view taken through the lines 5—5 of FIG. 4.
Figure 6:
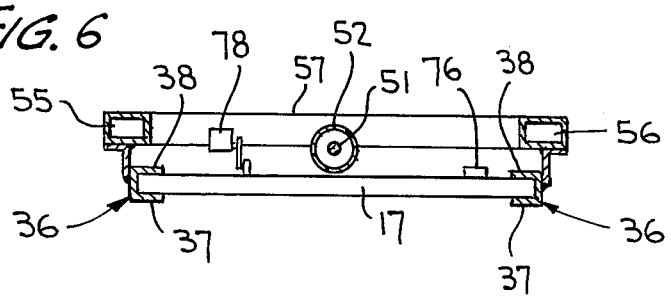
FIG. 6 is a sectional view taken through the lines 6—6 of FIG. 1.

Pressure plate 17 is horizontally translated between zone 18 and region 19 by horizontally translating shaft 51 parallel to the longitudinal axes of channels 38. Shaft 51 is hydraulically driven by a piston in its cylinder 52 that is fixedly mounted to cantilevered structure 35. Fixedly mounted on the end of shaft 51 that extends from cylinder 52 is circular disc 53 that is captured in rectangular housing 54, which is fixedly mounted on pressure plate 17. When pressure plate 17 is being driven from zone 18 into region 19, disc 53 engages the inside front wall of housing 54 to translate the pressure plate from channels 36 to channels 40 and 41; in an opposite manner, when pressure plate 17 is transferred from region 19 to zone 18, shaft 51 is driven into cylinder 52, whereby the inside, rear wall of housing 54 is engaged by disc 53. While pressure plate 17 is in region 19 and is being vertically driven in bin 11, shaft 51 remains in situ, with disc 53 in proximity to bin front wall 13, as illustrated in FIG. 4.

To vertically translate pressure plate 17 between region 19 and the interior of bin 11, after the pressure plate has been slid into channels 40 and 41, hydraulically driven shafts 61 and 62 are provided. Shafts 61 and 62 are fixedly connected to top flanges 42 of channels 40 and 41, respectively. Shafts 61 and 62 are vertically driven by pistons in cylinders 63 and 64 that extend upwardly from horizontally extending beams 55 and 56 that run generally parallel to walls 14 and 16 of bin 11. Cylinders 63 and 64 are located approximately in alignment with walls 14 and 16, respectively, and are approximately midway between walls 13 and 15. Such an arrangement minimizes the tendency for pressure plate 17 to rotate when it is applying a vertical force against a load in bin 11 and enables the force applied by the different segments of the pressure plate to be substantially equalized over the area of the load.

Because of differences in the materials loaded into different parts of bin 11, there is a tendency for pressure plate 17 to tilt between walls 14 and 16 as a load is being compressed. To prevent excessive tilting, the drive to both of shafts 61 and 62 is discontinued in response to the pressure exerted by the load against one of the shafts reaching a predetermined value. In response to the predetermined pressure being exerted by the load on one of the shafts, downward translation of pressure plate 17 ceases and upward translation of the pressure plate is initiated. Pressure plate 17 is translated upwardly until it returns to zone 19, at which time the pressure plate is translated by disc 53 engaging housing 54 and shaft 51 is retracted back into cylinder 52. As described infra, the sequence of operation is normally automatic, by providing a controller including appropriate microswitches for sensing different positions of pressure plate 17.

The pistons for driving shafts 51, 61 and 62 are hydraulically activated in response to fluid pressure supplied to cylinders 52, 63 and 64 by a control and power unit 71 fixedly connected to rearwardly extending, horizontal parallel legs 72. Unit 71 functions as a counterweight to stabilize the position of bin 11 and prevent possible tipping of the bin when pressure plate 17 is translated relative to zone 18. Pneumatic hoses and electric cables (not shown) extend between unit 71 and the various hydraulic and electrical devices included on the device. These connections will become apparent upon a description of the fluid schematic diagram of FIG. 7. An operator panel (not shown) is located on wall 16 to control signals supplied to and derived by unit 71. In normal operation, the operator need push a single button on the panel to initiate and complete a compaction cycle. If, however, it is desired to form a bale and remove it from bin 11, whereby pressure plate 17 remains in contact with the mass of compacted material, the operator presses a different button. To re-initiate the cycle after the bale has been formed and removed from bin 11, the operator must simultaneously press two different buttons to elevate pressure plate 17 into region 19 and return the pressure plate to zone 18. If desired, the operator can control the vertical position of plate 17, at will, by activating appropriate control buttons.

For the safety of operators and others, doors 21 and 31 must be closed to operate the device. To sense a closed position of doors 21 and 31, microswitch 72 is fixedly mounted on stationary cross beam 73 that extends between standards 22 and 34, above door 21, when closed. Door 21 only remains closed while it is latched to door 31, whereby microswitch 72 is engaged by the inner surface of door 21 only when both doors are closed. If door 21 is not closed, microswitch 72 is spring-biased outwardly, away from the interior of bin 11.

Complete forward translation of pressure plate 17 from zone 18 to region 19 is sensed by mounting microswitch 74 on crossed beam 75 which is vertically aligned with bin wall 15 and extends between beams 55 and 56. The feeler of microswitch 74 extends inwardly to bin 11 and is adapted to engage cam 76 that is fixedly mounted on the top of and rear edge of pressure plate 17 when the pressure plate has been moved fully into region 19 above the interior of bin 11. In response to microswitch 74 being engaged by cam 76, hydraulic control mechanism for the pistons in cylinders 63 and 64 is activated to translate shafts 61 and 62, and thereby pressure plate 17, downwardly.

Pressure plate 17 is driven upwardly in bin 11 until the top edge of the pressure plate engages microswitch 77, fixedly mounted on the underneath face of beam 55, within bin 11. Microswitch 77 is positioned within the bin beyond the edges of flanges 42 and 43 of channel 41, so that upward vertical motion of pressure plate 17 ceases when flanges 37 and 42 of channels 36 and 41 become horizontally aligned.

Pressure plate 17 is driven into zone 18 until the pressure plate engages microswitch 78 that is fixedly mounted on cross beam 57 so that it extends toward wall 15 of bin 11. Microswitch 78 engages the back vertical edge of pressure plate 17 when the pressure plate has been fully retracted into zone 18.

Figure 7:
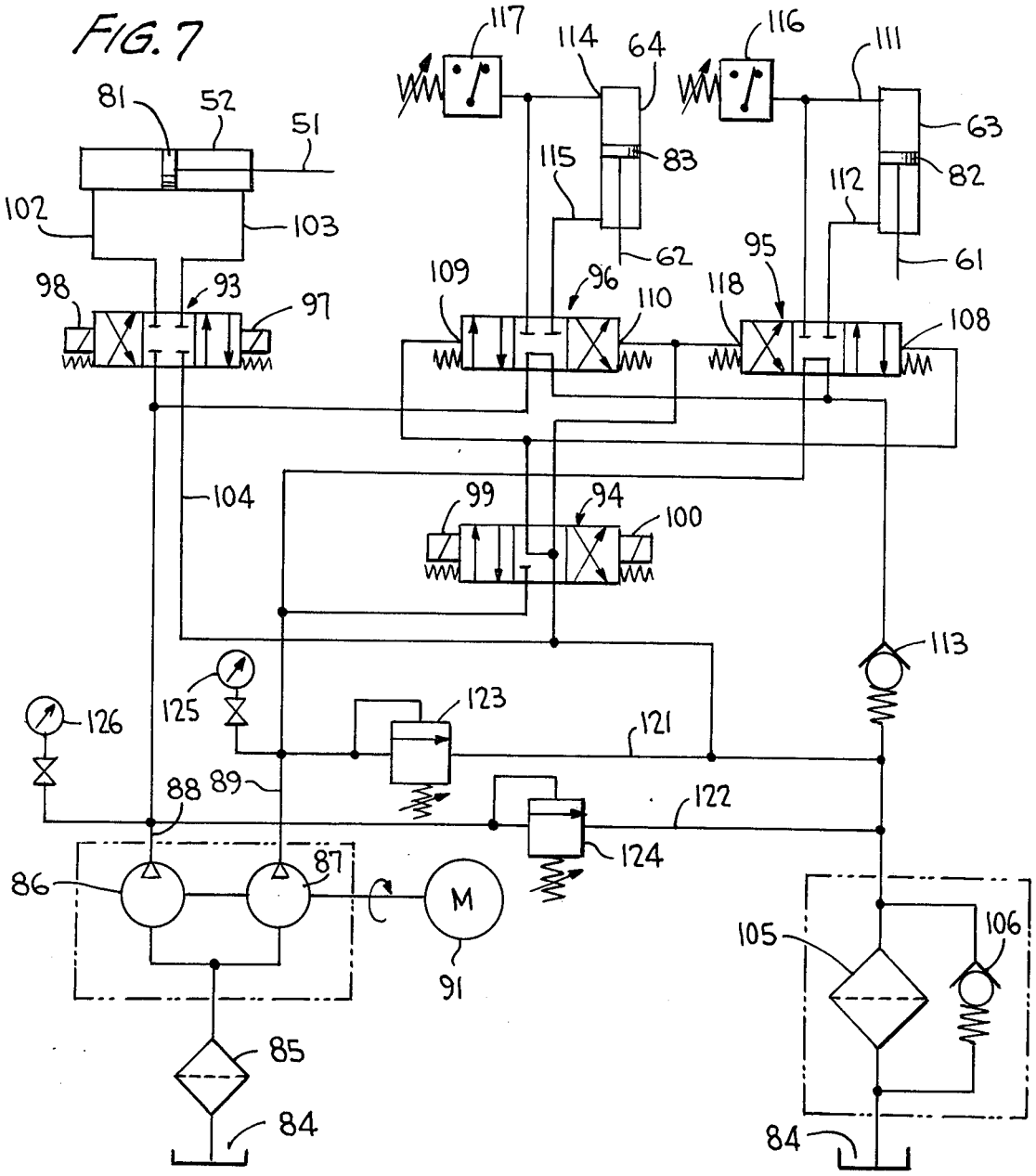
FIG. 7 is a schematic diagram of the hydraulic network utilized with the device illustrated in FIGS. 1-6.

Reference is now made to FIG. 7 of the drawing wherein there is illustrated a schematic diagram of a hydraulic circuit for driving pistons 81, 82, and 83 which are respectively positioned in cylinders 52, 63 and 64 to drive shafts 51, 61 and 62. Basically, the hydraulic circuit includes a single branch for driving piston 81 and a pair of parallel branches for driving pistons 82 and 83. The branches for driving pistons 81–83 are supplied with fluid pressure from a sump or reservoir 84 that is included in equipment 71. Fluid from reservoir 84 is drawn through filter 85 by pumps 86 and 87 that are respectively provided in parallel lines 88 and 89, and which are driven by motor 91. Reservoir 84, filter 85, pumps 86 and 87, and motor 91, as well as the pneumatic logic circuits and other filters associated with FIG. 7, are all mounted on unit 71.

The logic circuit for controlling activation of pistons 81–83 includes four spring-biased, 3-way spool valves 93–96. Spool valves 93 and 94 are solenoid energized, while valves 95 and 96 are pneumatically energized. The springs bias the valves so that when no electric or pneumatic forces are applied to control inputs of the valves, the valves return to the neutral condition illustrated.

As a safety feature, pressure plate 17 can be moved only while doors 21 and 31 are closed. To this end, solenoids 97 and 98 of valve 93 and solenoids 99 and 100 of valve 94, which valves respectively control the horizontal and vertical translation of the pressure plate, can be energized only while microswitch 73 is closed in response to doors 21 and 31 being closed. In response to doors 21 and 31 being open, microswitch 73 is open, whereby solenoids 97–100 are de-energized and valves 93 and 94 are in the neutral position wherein no fluid flows to cylinders 52, 63 and 64. In all future description of the operation of FIG. 7, it is assumed that doors 21 and 31 and microswitch 73 are closed, unless otherwise indicated.

To horizontally translate pressure plate 17 from zone 18 to region 19, solenoid valve 93 is energized so that a fluid flow path is established from hydraulic line 88 through the valve and line 102 into one end of cylinder 52. Low pressure flow is from the other end of cylinder 52, through line 103, valve 93, line 104 to sump 84 via filter 105 that is bypassed by check valve 106. To these ends, solenoid 97 is energized in response to an operator activating an automatic start button to translate spool valve 93 from right to left, as illustrated in FIG. 7. Solenoid 97 remains energized until pressure plate 17 has been translated completely into region 19, at which time the solenoid is de-energized in response to microswitch 74 being contacted by pressure plate 17. In response to microswitch 74 being engaged by pressure plate 17, solenoid 97 is de-energized and valve 93 is returned to its neutral state whereby further flow of fluid from line 88 to line 102 ceases and piston 81 and shaft 51 remain in situ. Piston 81 and shaft 51 remain in place while pressure plate 17 is vertically translated in bin 11 until the pressure plate returns to region 19. When pressure plate 17 returns vertically from bin 11 to region 19, microswitch 77 is engaged by the pressure plate to energize solenoid 98. Energization of solenoid 98 causes the spool of valve 93 to be translated from the neutral position to the right, as illustrated in FIG. 7, whereby fluid flows from line 88 to line 103, to drive piston 81, shaft 51 and pressure plate 17 from region 19 back to zone 18. Solenoid 98 remains energized until pressure plate 17 engages microswitch 78, at which time solenoid 98 is de-energized and valve 93 returns to its neutral position.

Spool valves 94–96 control the vertical movement of pressure plate 17 by providing a pair of parallel fluid paths to pistons 82 and 83 in cylinders 63 and 64. Valve 94 is effectively a control valve for supplying fluid pressure to spool valves 95 and 96 that respectively control the application of fluid pressure from lines 88 and 89 to cylinders 63 and 64.

During normal operation, solenoid 99 is energized in response to microswitch 74 sensing that pressure plate 17 has been translated from zone 18 into region 19. Energization of solenoid 99 shifts the spool of valve 94 from left to right, as illustrated in FIG. 7, so that fluid flows from line 89 to ports 108 and 109 of valves 95 and 96, respectively. In response to fluid pressure being applied to port 108, valve 95 is energized so that a fluid flow path is established through the valve between line 89 and line 111, connected to one end of cylinder 63. A return path is provided from the other end of cylinder 63 through line 112 and spool valve 95 to sump 84 via check valve 113 and filter 105. The application of fluid pressure to port 109 causes valve 96 to be energized so that a flow path is provided from line 89 through the spool valve to line 114 at one end of cylinder 64. A return, low-pressure flow is provided between the other end of cylinder 64 through line 115 and valve 96 to sump 84.

Thereby, a pair of parallel circuits is provided to drive pistons 82 and 83 downwardly so that the pressure plate 17 is driven downwardly in bin 11. Pressure plate 17 continues to be driven downwardly in bin 11 until the force exerted by the load in the bin is such that the high pressure exerted against a driving face of piston 82 or 83 reaches a predetermined value, such as 1200 psi. The pressure exerted against the high pressure faces of pistons 82 and 83, during the downward stroke of the pistons is sensed by pressure sensing switches 116 and 117, which are respectively connected in lines 111 and 114. Switches 116 and 117 can be set at any variable pressure, typically between 800 and 2000 psi which is translated into a compressing force of 24 tons.

Energization of switches 116 or 117 results in de-energization of solenoid 99, whereby valve 94 is returned to the neutral state and fluid is no longer applied to ports 108 and 109 of valves 95 and 96. Thereby, the flow of fluid through valves 95 and 96 to cylinders 63 and 64 is terminated and downward movement of pressure plate 17 ceases.

Under normal, automatic operation, de-energization of solenoid 99 is followed immediately by energization of solenoid 100, whereby fluid is supplied by lines 88 and 89 through valve 94 to ports 118 and 119 of valves 95 and 96, respectively. In response to fluid supplied to port 118, valve 95 is energized so that a fluid flow path is established from line 88 to line 112, and a return path is provided from line 111 to sump 84. In response to fluid being applied to port 119, solenoid 96 is activated so that fluid is supplied from line 89 to line 115, and a low pressure return path is provided from line 114 through valve 96 to sump 84. The high pressure fluid applied to lines 112 and 115 causes pistons 82 and 83, and therefore pressure plate 17, to be driven upwardly until microswitch 77 is engaged by the pressure plate, at which time solenoid 100 is de-energized. In response to solenoid 100 being de-energized, valve 94 returns to its neutral position, and fluid pressure is removed from ports 118 and 119 so that valves 95 and 96 return to their neutral positions. With valves 94–96 in their neutral positions, no further upward movement of pressure plate 17 occurs. As described supra, after pressure plate 17 returns to region 19, valve 93 is energized so that high pressure is applied to line 103 and the pressure plate is returned to zone 18.

If it is desired to wrap a mass of material that has been compacted in bin 11, the operator activates a second button after activating the automatic start button, whereby pressure plate 17 remains in situ in response to either of switches 116 or 117 being activated. In this sequence, only solenoid 99 is energized in response to activation of switch 116 or 117 and solenoid 100 is not activated in response to energization of one of the switches. In response to pressure plate 17 compacting the load, valve 94 returns to the neutral state and fluid pressure is removed from control ports 108, 109, 118 and 119 of valves 95 and 96, whereby all of the valves are in the neutral position. There is no movement of pistons 82 and 83 and the fluid pressure inside of cylinders 63 and 64 holds plate 17 in situ. The operator is now free to open door 21, put baling wire around the compacted mass in bin 11 and remove the mass. Thereafter, doors 21 are closed and the operator activates a pair of buttons to initiate the automatic sequencing, whereby solenoid 100 is again activated and fluid flows to lines 112 and 115 to return pressure plate 17 to zone 19. Also, manually controlled switches for solenoids 99 and 100 are provided to lower and raise pressure plate 17 at will, and therefore to effectively manually control the vertical position of the pressure plate.

As a safety feature, if the pressure in lines 88 or 89 becomes excessive, shunt lines 121 and 122 are automatically inserted between lines 88 and 89 and sump 84 to prevent activation of pistons 81–83. Shunt lines 121 and 122 include normally closed, pressure actuated valves 123 and 124 that are opened to allow fluid to flow through them in response to the pressure in lines 88 and 89 exceeding a predetermined value, determined by the spring bias applied to valves 123 and 124. The fluid pressures in lines 88 and 89 are independently monitored by pressure sensing meters 125 and 126 respectively connected to lines 88 and 89.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A device for compacting trash and the like comprising a bin for receiving the material to be compacted, said bin having an open top through which the material can be deposited into the bin and walls which define a volume into which the material is deposited in the bin, a horizontally disposed pressure plate for compacting the material, means for horizontally driving the pressure plate into a region above the volume where the material is deposited, and means for vertically driving the pressure plate between the region and the volume to compact the material in the bin and to return the plate to the region, each of said driving means including at least one cylinder and a piston that is driven in the cylinder, all of said cylinders being stationary relative to said bin.

2. The device of claim 1 further including a door on one of the walls for enabling the compacted material to be removed from the bin.

3. The device of claim 2 wherein said bin includes a floor and another wall opposite from the door, the floor, another wall and pressure plate having mating longitudinal grooves through which baling wires may be inserted while the door is open.

4. A device for compacting trash and the like comprising a bin for receiving the material to be compacted, said bin having walls which define a volume where the material is deposited in the bin, a horizontally disposed pressure plate, means for vertically driving the pressure plate between a region above the volume and the volume to compact the material in the bin and to return the plate to the region, said driving means including first and second vertical pistons respectively positioned to drivingly engage opposite edges of the pressure plate, the driving means including fluid pressure means for separately driving each of the pistons, the means for driving each of the pistons including a separate fluid pump connected to a separate supply line for each of the pistons, and means responsive to the fluid pressure acting on one of the pistons reaching a predetermined value for deactivating the drive means for both of the pistons.

5. The device of claim 4 wherein the driving means includes control means for supplying control signals to a separate power valve in each of said supply lines, said control means being responsive to the fluid pressure acting on the pistons so that there is flow from the fluid pumps to the pistons through the power valves while the fluid pressure acting on both of the pistons is less than the predetermined value and the power valves are activated so there is no flow from the fluid pumps to either of the pistons while the fluid pressure acting on either of the pistons exceeds the predetermined value.

6. A device for compacting trash and the like comprising a bin for receiving the material to be compacted, said bin having an open top through which the material can be deposited into the bin and walls which define a volume into which the material is deposited in the bin, a horizontally disposed pressure plate for compacting the material, means for horizontally driving the pressure plate into a region above the volume where the material is deposited, and means for vertically driving the pressure plate between the region and the volume to compact the material in the bin and to return the plate to the region, said means for vertically driving including: a first horizontally disposed shelf means for holding the pressure plate, and means for vertically driving the first shelf means between the region and the volume while the pressure plate is held by the first shelf means; a second horizontally disposed shelf means for holding the pressure plate at a zone horizontally removed from the volume while the material is deposited in the bin and while the pressure plate is being horizontally driven; said first and second shelf means being in substantially the same horizontal plane while the pressure plate is being horizontally driven so that the pressure plate is transferred between the first and second shelf means while the plate is being horizontally driven.

7. The drive of claim 6 wherein the horizontal drive means includes a piston that is driven in a cylinder that is stationary relative to said bin.

8. The device of claim 6 wherein the first shelf means includes a pair of channels for respectively receiving opposite edges of the pressure plate, each of said channels including upper and lower horizontally extending flanges between which the pressure plate extends.

9. The device of claim 8 wherein one of the flanges of each of the channels includes a flared end for receiving the pressure plate from the second shelf means.

10. The device of claim 8 wherein said vertical driving means includes first and second vertical pistons respectively connected to the first and second channels.

11. The device of claim 10 wherein the vertical driving means includes fluid pressure means for separately driving each of the pistons, and means responsive to the fluid pressure acting on one of the pistons reaching a predetermined value for deactivating the drive means for both of the pistons.

12. The device of claim 10, further including a cylinder for each of said pistons, said cylinders being stationary relative to the bin.

13. A device for compacting trash and the like comprising a bin for receiving the material to be compacted, said bin having an open top through which the material can be deposited into the bin and walls which define a volume into which the material is deposited in the bin, a horizontally disposed pressure plate for compacting the material, means for horizontally driving the pressure plate into a region above the volume where the material is deposited, and means for vertically driving the pressure plate between the region and the volume to compact the material in the bin and to return the plate to the region, means responsive to the pressure plate being horizontally driven to the region for disabling the horizontal driving means and for activating the vertical driving means to drive the pressure plate into the volume, means responsive to the pressure plate being vertically driven to the region for disabling the vertical driving means and for activating the horizontal driving means to drive the pressure plate away from the region, and means responsive to the pressure plate being driven from the region to a zone horizontally removed from the region for disabling the horizontal driving means.

14. The device of claim 13 wherein the vertical driving means includes fluid pressure means for driving the pressure plate downwardly into the volume, and means responsive to the driving fluid pressure reaching a predetermined value for disabling the downward drive of the pressure plate into the volume.

15. A device for compacting trash and the like comprising a bin for receiving the material to be compacted, said bin having an open top through which the material can be deposited into the bin and walls which define a volume into which the material is deposited in the bin, a horizontally disposed pressure plate for compacting the material, means for horizontally driving the pressure plate into a region above the volume where the material is deposited, and means for vertically driving the pressure plate between the region and the volume to compact the material in the bin and to return the plate to the region, said vertical driving means including first and second vertical pistons respectively positioned to drivingly engage opposite edges of the pressure plate, said driving means including fluid pressure means for separately driving each of the pistons, the means for driving each of the pistons including a separate fluid pump connected to a separate supply line for each of the pistons, and means responsive to the fluid pressure acting on one of the pistons reaching a predetermined value for disconnecting fluid pumps from both of the pistons.

16. The device of claim 15 wherein the driving means includes control means for supplying control signals to a separate power valve in each of said supply lines, said control means being responsive to the fluid pressure acting on the pistons so that there is flow from the fluid pumps to the pistons through the power valves while the fluid pressure acting on both of the pistons is less than the predetermined value and the power valves are activated so there is no flow from the fluid pumps to either of the pistons while the fluid pressure acting on either of the pistons exceeds the predetermined value.

* * * * *